US008574402B2

(12) United States Patent
Samuelsson et al.

(10) Patent No.: US 8,574,402 B2
(45) Date of Patent: Nov. 5, 2013

(54) FEEDING SYSTEM HAVING PUMPS IN PARALLEL FOR A CONTINUOUS DIGESTER

(75) Inventors: Anders Samuelsson, Hammaro (SE); Jonas Saetherasen, Hammaro (SE); Daniel Trolin, Karlstad (SE)

(73) Assignee: Metso Paper Sweden AB, Sundsvall (SE)

( * ) Notice: Subject to any disclaimer, the term of this patent is extended or adjusted under 35 U.S.C. 154(b) by 435 days.

(21) Appl. No.: 12/933,423

(22) PCT Filed: Mar. 19, 2009

(86) PCT No.: PCT/SE2009/050290
§ 371 (c)(1),
(2), (4) Date: Dec. 3, 2010

(87) PCT Pub. No.: WO2009/116943
PCT Pub. Date: Sep. 24, 2009

(65) Prior Publication Data

US 2011/0259539 A1 Oct. 27, 2011

(30) Foreign Application Priority Data

Mar. 20, 2008 (SE) ..... 0800647

(51) Int. Cl.
*D21C 7/06* (2006.01)

(52) U.S. Cl.
CPC ..... *D21C 7/06* (2013.01)
USPC ..... 162/243; 162/241; 162/246

(58) Field of Classification Search
USPC ..... 162/243
See application file for complete search history.

(56) References Cited

U.S. PATENT DOCUMENTS

| | | | | |
|---|---|---|---|---|
| 3,532,594 | A * | 10/1970 | Richter | 162/19 |
| 5,753,075 | A | 5/1998 | Stromberg | |
| 6,841,042 | B2 * | 1/2005 | Stromberg et al. | 162/237 |
| 2001/0022283 | A1 | 9/2001 | Bilodeau | |

FOREIGN PATENT DOCUMENTS

| | | | |
|---|---|---|---|
| WO | WO 2006101449 | A1 * | 9/2006 |
| WO | WO 2007036603 | A1 * | 4/2007 |

OTHER PUBLICATIONS

U.S. D.O.E., Improving Pumping System Performance, 2006, U.S. D.O.E.*

* cited by examiner

*Primary Examiner* — Anthony Calandra
(74) *Attorney, Agent, or Firm* — Rolf Fasth; Fasth Law Offices

(57) ABSTRACT

The feed system is for a continuous digester where at least two pumps are arranged in parallel at the bottom of a pre-treatment vessel. The outlets of the pumps are combined at a merging point before a common transfer line extends to the top of the digester. The system makes it possible to provide a feed system with an improved accessibility and operational reliability, and to operate the main part of the pumps at optimal efficiency even if the production capacity is reduced.

8 Claims, 5 Drawing Sheets

FEEDING SYSTEM HAVING PUMPS IN PARALLEL FOR A CONTINUOUS DIGESTER

PRIOR APPLICATION

This application is a U.S. national phase application based on International Application No. PCT/SE2009/050290, filed 19 Mar. 2009 claiming priority from Swedish Patent Application No. 0800647-0, filed 20 Mar. 2008.

TECHNICAL FIELD

The present invention relates to a feed system for a continuous digester in which wood chips are cooked for the production of cellulose pulp.

BACKGROUND AND SUMMARY OF THE INVENTION

In older conventional feed systems for continuous digesters, high-pressure pocket feeders have been used as sluice feeders for pressurisation and transport of a chips slurry to the top of the digester.

The *Handbook of Pulp*, (Herbert Sixta, 2006) discloses this type of feeding with high-pressure pocket feeders (*High Pressure Feeder*) on page 381. The big advantage with this type of feed is that the flow of chips does not need to pass through pumps, but is instead transferred hydraulically. At the same time it is possible to maintain a high pressure in the transfer circulation to and from the digester without losing pressure. The system however has some disadvantages in that the high-pressure pocket feeder is subjected to wear and must be adjusted so that the leakage flow from the high-pressure circulation to the low-pressure circulation is minimized. Another disadvantage is that, during transfer, the temperature must be kept low so that bangs related to steam implosions do not occur in the transfer.

As early as 1957, U.S. Pat. No. 2,803,540 disclosed a feed system for a continuous chip digester where the chips are pumped from an impregnation vessel to a digester in which the chips are cooked in a steam atmosphere. Here, a part of the cooking liquor is charged to the pump to obtain a pumpable consistency of 10%. However, this digester was designed for small scale production of 150-300 tons pulp per day (see col. 7, r. 35).

Also, U.S. Pat. No. 2,876,098 from 1959 discloses a feed system for a continuous chip digester without a high-pressure pocket feeder. Here the chips are suspended in a mixer before they are pumped with a pump to the top of the digester. The pump arrangement is provided under the digester and here the pump shaft is also fitted with a turbine in which pressurised black liquor is depressurised to reduce the required pumping power.

U.S. Pat. No. 3,303,088 from 1967 also discloses a feed system for a continuous chip digester without a high-pressure pocket feeder, where the wood chips are first steamed in a steaming vessel, followed by suspension of the chips in a vessel, whereafter the chips suspension is pumped to the top of the digester.

U.S. Pat. No. 3,586,600 from 1971 discloses another feed system for a continuous digester mainly designed for finer wood material. Here, a high-pressure pocket feeder is not used either, and the wood material is fed with a pump 26 via an upstream impregnation vessel to the top of the digester.

Similar pumping of finer wood material to the top of a continuous digester is also disclosed in EP157279.

Typical for these embodiments of digester systems from the late 50's to the beginning of the 70's is that these were designed for small digester houses with a limited capacity of about 100-300 tons pulp per day.

U.S. Pat. No. 5,744,004 shows a variation of feeding wood chips into a digester where the chips mixture is fed into the digester via a series of pumps. Here, so called DISCFLO™ pumps are used. A disadvantage with this system is that this type of pump typically has a very low pump efficiency.

The previously mentioned *Handbook of Pulp* also discloses on page 382 an alternative pump feed of chips mixtures called TurboFeed™. Here three pumps are used in series to feed the chips mixture to the digester. This type of feed has been patented in U.S. Pat. No. 5,753,075, U.S. Pat. No. 6,106,668, U.S. Pat. No. 6,325,890, U.S. Pat. No. 6,336,993 and U.S. Pat. No. 6,551,462; however in many cases, U.S. Pat. No. 3,303,088 for example, has not been taken into consideration.

U.S. Pat. No. 5,753,075 relates to pumping from a steaming vessel to a processing vessel.

U.S. Pat. No. 6,106,668 relates specifically to the addition of AQ/PS during pumping.

U.S. Pat. No. 6,325,890 relates to at least two pumps in series and the arrangement of these pumps at ground level.

U.S. Pat. No. 6,336,993 relates to a detail solution where chemicals are added to dissolve metals from the wood chips and then drawing off liquor after each pump to reduce the metal content of the pumped chips.

U.S. Pat. No. 6,551,462 essentially relates to the same system already disclosed in U.S. Pat. No. 3,303,088.

A big disadvantage with the systems with multiple pumps in series is limited accessibility. If one pump breaks down, the whole digester system stops. With 3 pumps in series and a normal accessibility for each pump of 0.95, the total systems accessibility is just 0.86 (0.95*0.95*0.95=0.86).

Today's modern continuous digesters with capacities over 4000 tons pulp per day use digesters that are 50-75 meters high, and where a gauge pressure of 3-8 bar is established in the top of the digester in the case of a steam phase digester or 5-20 bar in the case of a hydraulic digester. The continuous digester systems are designed to, during the main part of operation, typically well over 80-95% of operation, run at nominal production, which makes it necessary, with regard to operational costs, for the pumps to be optimized for nominal production.

A typical digester system with a capacity of about 3000 tons with a feed system with the so called "TurboFeed™" technology requires about 800 kW of pumping power. It is obvious that these systems must have pumps that run at an optimized efficiency close to their nominal capacity. Such a feed system requires 19,200 kWh (800*24) per 24 hours, and at a price of 50 Euro per MWh, the operational cost comes to 960 Euro per 24 hours or 336,000 Euro per year.

The systems must also be able to be operated within 50-110% of nominal production which places great demands on the feed system.

This means that a system supplier must offer pumps that are large enough to handle 4000 tons but can and at the same time be operated within a 2000-4400 ton interval. Such a pump operated at 50% of its capacity is far from optimised, but it is necessary to at least temporarily be able to operate the pump at limited capacity in case of temporary capacity problems, for example further down the fibre line.

If this system supplier offers digester systems that can handle nominal capacities of 500-5000 tons, then pumps must be designed in a number of different pump sizes so that each individual installation can offer, from a power consumption and energy perspective, optimised transfer at nominal production. This makes the pumps very expensive, as normally a very limited series of pumps are manufactured in each size. To be able to meet demands of reasonably short delivery times, the system supplier must stock pumps in all pump sizes which is very expensive.

The digester feed should also be able to guarantee optimal feeding to the top of the digester even if the flow in the transfer line is reduced to 50% of nominal flow.

This is difficult, because the flow rate in the transfer lines should be maintained above a critical level, as well-steamed chips have a tendency to sink against the direction of the transfer flow if the speed becomes too low.

A corrective measure that can be used at low rates is to increase the dilution before pumping so that a lower chips concentration is established. However, this is not energy efficient as it forces the feed systems to pump unnecessarily high volumes of fluid which increases the required pumping power per produced unit of pulp.

Each pump has a construction point (Best Efficiency Point/ "BEP") at which the pump is intended to work. At this "BEP", shock induced loss and frictional loss are, in the case of centrifugal pumps, at their lowest which in turn leads to that the pumps efficiency is highest at this point.

A first aim of the present invention is to provide an improved feed system for wood chips wherein optimal transfer can be achieved within a broader interval around the digesters design capacity.

Other aims of the present invention are;

improved efficiency of the feed system;

improved accessibility;

lower operational costs per pumped unit of chips;

constant chips concentration during pumping regardless of production level;

a limited range of pump sizes that can cover a broad span of the digesters production capacity;

simplified maintenance;

lower installation costs compared to feed systems with high-pressure pocket feeders or multiple pumps in series;

The above mentioned aims may be achieved with a feed system according to the present invention.

DETAILED DESCRIPTION OF THE INVENTION

Figure 1:
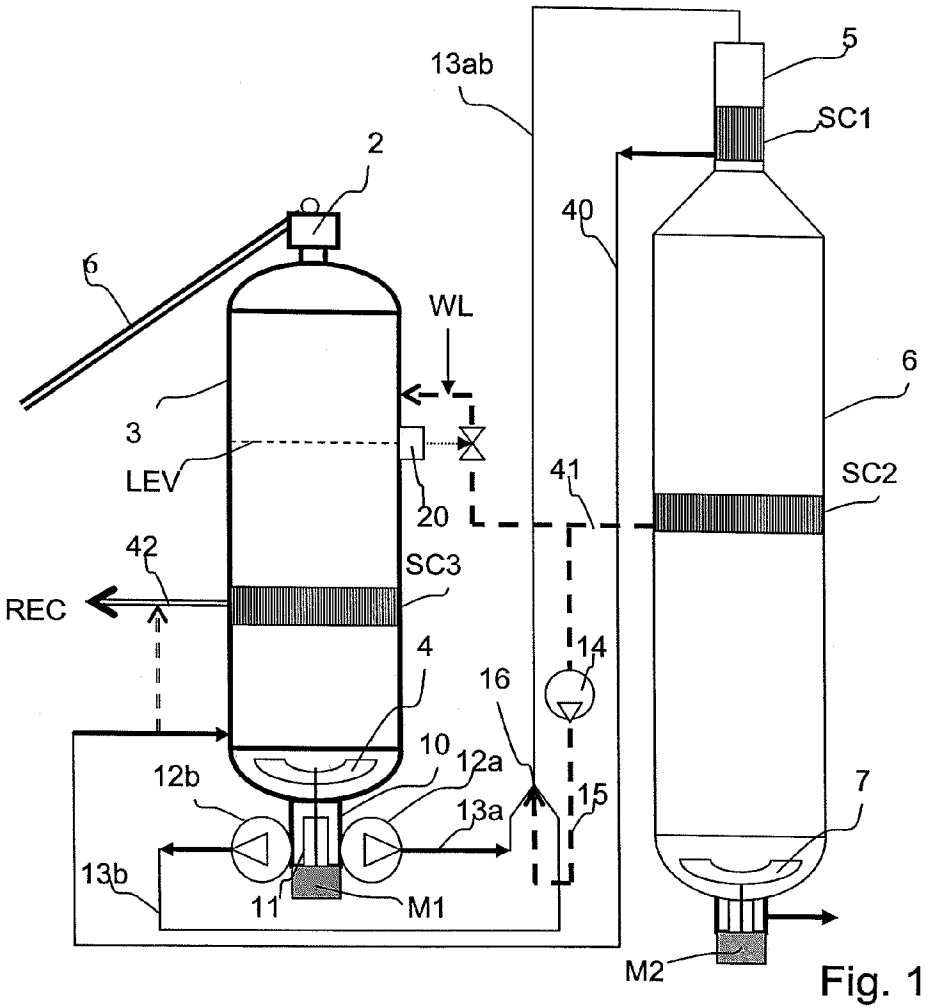
FIG. 1 shows a first system solution for feed systems for digesters without a top separator.

In the following detailed description the phrase "feed system for a continuous digester" will be used. "Feed system" herein means a system that feeds wood chips from a low-pressure chips processing system, typically with a gauge pressure under 2 bar and normally atmospheric, to a digester where the chips are under high pressure, typically between 3-8 bar in the case of a steam phase digester or 5-20 bar in the case of a hydraulic digester.

The term "continuous digester" herein means either a steam phase digester or a hydraulic digester even though the preferred embodiments are exemplified with steam phase digesters.

A basic concept is that a feed system comprises at least 2 pumps in parallel, but preferably even 3, 4 or 5 pumps in parallel. It has been shown that a single pump can feed a chips suspension to a pressurised digester, and it is therefore possible to exclude conventional high-pressure pocket feeders or complicated feed systems with 2-4 pumps in series.

The pumps are arranged in a conventional way on the foundation at ground level to facilitate service.

With the above outlined solution it is possible to provide feed systems for digester production capacities from 750 to 6000 tons pulp per day, with only a few pump sizes. This is vey important, as these pumps for feeding wood chips at relatively high concentration are very specific in regard to their applications, and pumps that are able to handle production capacities of 4000-6000 tons pulp per day are very large and only manufactured in very limited series of a few pumps per year. The cost for these pumps therefore make up a large part of the total cost of running a digester system.

The table below shows an example of how it is possible to cover a production interval of 750-6000 ton with only two pump sizes optimised for 750 and 1500 ton pulp, respectively, per day;

PUMP PROGRAM

| Nominal Production Capacity (ton per day) | 750 pump | 1500 pump |
|---|---|---|
| 750 | 1 unit | |
| 1500 | 2 units | |
| 2250 | 1 unit | 1 unit |
| (2250 alt) | (3 units*) | — |
| 3000 | — | 2 units |
| (3000 alt) | (4 units*) | |
| 3750 | 1 unit | 2 units |
| 4500 | — | 3 units |
| (4500 alt) | (2 units*) | (2 units*) |
| 5250 | 1 unit | 3 units |
| 6000 | | 4 units |

(X units* = 1:st alternative) st alternative)

This table clearly shows how it is possible to, with the concept according to the present invention, cover production capacities between 1500-6000 tons with only 2 optimised pump sizes while using a single pump installation in smaller digester systems with a capacity below 750 tons. Continuous digesters with a capacity of 750 tons are seldom used for new installations today, because batch digester systems are often more competitive for these capacities. A certain after market may exist for older digester systems with a low capacity where expensive feed systems with high-pressure pocket feeders are still used.

First Embodiment

FIG. 1 shows an embodiment of the feed system with at least 2 pumps in parallel. The chips are fed with a conveyor belt 1 to a chips buffer 2 arranged on top of an atmospheric treatment vessel 3. In this vessel, a lowest liquid level, $LIQ_{LEV}$, is established by adding an alkali impregnation liquid, preferably cooking liquor (black liquor) that has been drawn off in a strainer screen SC2 in a subsequent digester 6, and with possible addition of white liquor and/or another alkali filtrate.

The chips are fed with normal control of the chip level $CH_{LEV}$ which is established above the liquid level $LIQ_{LEV}$.

The remaining alkali content in the black liquor is typically between 8-20 g/l. The amount of black liquor and other alkali liquids that are added to the treatment vessel 3 is regulated with a level transmitter 20 that controls at least one of the flow valves in lines 40/41. With this alkali impregnation liquor the wood acidity in the chips may be neutralised and impregnated with sulphide rich ($HS^-$) liquid. Spent impregnation liquor, with a remaining alkali content of about 2-5 g/l, preferably 5-8 g/l, is drawn off from the treatment vessel 3 via the withdrawal strainer SC3 and sent to recovery REC. If necessary, white liquor WL may also be added to the vessel 3, for example as shown in the figure to line 41. The actual remaining alkali content depends on the type of wood used, softwood or hardwood, and which alkali profile that is to be established in the digester.

In the case where a raw wood material that is easy to impregnate and neutralise is used, for example raw wood material such as pin chips or wood chips with very thin dimensions and a quick impregnation time, vessel 3 may in extreme cases be a simple spout with a diameter essentially corresponding to the bucket formed outlet 10 in the bottom of the vessel. Required retention time in the vessel is determined by the time it takes for the wood to become so well impregnated that it sinks in a free cooking liquor.

After the chips have been processed in vessel 3 they are fed out from the bottom of the vessel where also a conventional bottom scraper 4 is arranged, driven by a motor M1.

According to the invention, the chips are fed to the digester via at least 2 pumps 12*a*, 12*b* in parallel, and these pumps are connected to a bucket formed outlet 10 in the bottom of the vessel. The bucket formed outlet 10 has an upper inlet, a cylindrical mantle surface, and a bottom. The pumps are connected to the cylindrical mantle surface.

To facilitate pumping of the chips mixture the chips are suspended in a vessel 3 to create a chips suspension, in which vessel is arranged a fluid supply via lines 40/41, controlled by a level transmitter 20 that establishes a liquid level $LIQ_{LEV}$ in the vessel, and above the pump level by at least 10 meters, and preferably at least 15 meters and even more preferably at least 20 meters. Hereby a high static pressure is established in the inlet to pumps 12*a* and 12*b* so that one single pump can pressurise and transfer the chips suspension to the top of the digester without cavitation of the pump. The top of the digester is typically arranged at least 50 meters above the level of the pump, usually 60-75 meters above the level of the pump while a pressure of 5-10 bar is established in the top of the digester.

To further facilitate feeding to the pumps, a stirrer 11 is arranged in the bucket formed outlet. The stirrer 11 is preferably arranged on the same shaft as the bottom scraper and driven by the motor M1. The stirrer has at least 2 scraping arms that sweep over the pump outlets arranged in the bucket formed outlet's mantle surface. Preferably a dilution is arranged in the bucket formed outlet, which may be accomplished by dilution outlets (not shown) connected to the upper edge of the mantle surface.

FIGS. 3-6 show how a number of pumps 12*a*-12*d* may be connected to the outlet's cylindrical mantle surface and how the stirrer 11 may be fitted with up to 4 scraping arms. The pumps may preferably be arranged symmetrically around the outlet's cylindrical mantle surface with a distribution in the horizontal plane of 90° between each outlet if there are 4 pump connections (120° if there are 3 pump connections and 180° if there are 2 pump connections). This way it is possible to avoid an uneven distribution of the load on the bottom of the vessel and its foundation. In practice, shut-off valves (not shown) are also arranged between the outlet's 10 mantle surface and the pump inlet and a valve directly after the pump to make it possible to shut off the flow through one pump if this pump is to be replaced during continued operation of the remaining pumps.

In FIG. 1 the chips are fed by the pumps 12*a*, 12*b* via a first section 13*a*, 13*b* of a transfer line to the top of the digester, and the first sections of the transfer lines from at least 2 pumps are combined at a merging point 16 to form a combined second section 13*ab* of the transfer line before this second section is led to-wards the top of the digester. To facilitate feeding, a supply line 15 is also connected to the merging point 16. In this embodiment, black liquor is taken from line 41 and may be pressurised with a pump 14. However, because the black liquor has already reached a full digester pressure, the need to pressurise the liquor is limited.

Excess liquid from transfer is drawn off with a strainer SC1 before it is led back in line 40.

The digester 6 may be fitted with a number of digester circulations and with a supply of white liquor to the top of the digester or to the digesters addition flows (not shown). The figure shows a withdrawal of cooking liquor via strainer SC2.

The cooking liquor drawn off from strainer SC2 is termed black liquor and may have a somewhat higher content of remaining alkali than black liquor that is normally sent directly to recycling and normally drawn off further down in the digester. The cooked chips P are then fed out from the bottom of the digester with the help of a conventional bottom scraper 7 and the cooking pressure.

Second Embodiment

Figure 2:
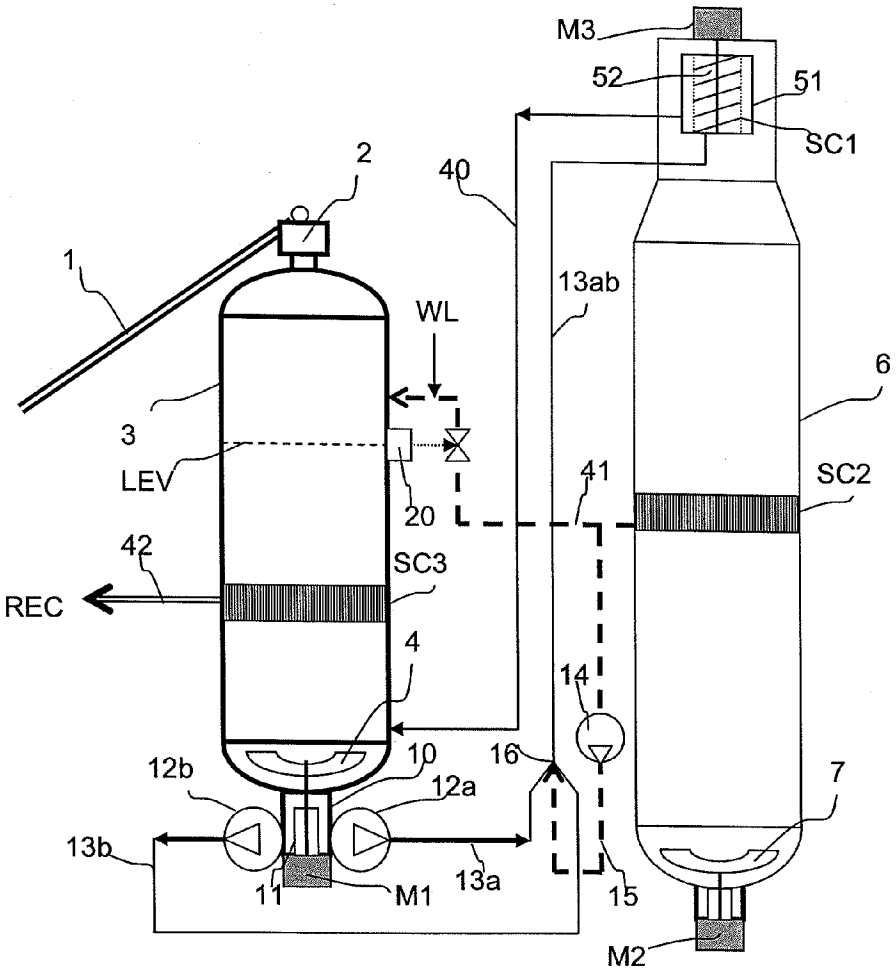
FIG. 2 shows a first system solution for feed systems for digesters without a top separator; a top separator.
Figure 3:
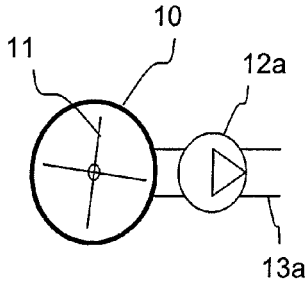
FIGS. 3-6 show different ways of attaching pumps to an outlet in a pre-treatment vessel.
Figure 4:
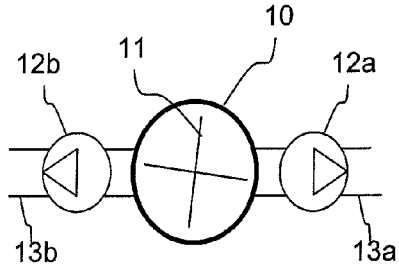
Figure 5:
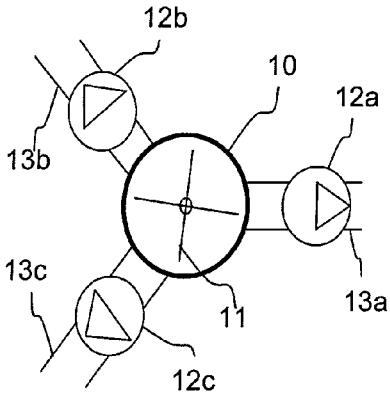
Figure 6:
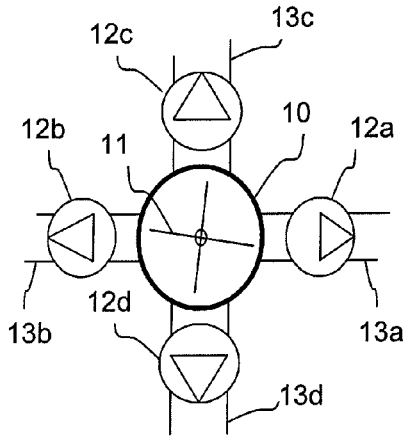

FIG. 2 shows an alternative embodiment where a conventional top separator 51 is arranged in the top of the digester. The first sections 13*a*, 13*b* of the transfer lines from at least 2 pumps 12*a*, 12*b* are combined at a merging point 16 to form a combined second section 13*ab* of the transfer line before this other section is led towards the top of the digester. To facilitate feeding, a supply line 15 is also connected to the merging point 16. In this embodiment, black liquor is taken from line 41 and may be pressurised with a pump 14. However, because the black liquor has already reached a full digester pressure, the need to pressurise the liquor is limited.

The transfer lines 13*ab*, open into the bottom of the top separator, where, driven by motor M3, a feeding screw 52 drives the chips slurry up under a dewatering process against the top separator's withdrawal strainer SC1. Excess liquid is collected in a withdrawal space 51.

Drained chips will then be fed out from the upper outlet of the separator in a conventional way and fall down into the digester.

The, from the top separator 51, drained liquid is led through a line 40 back to the processing vessel 3, and may preferably be added to the bottom of the processing vessel, to there facilitate feeding out under dilution.

The remaining parts of this embodiment correspond to the digester house shown in FIG. 1.

All other characterizing parts of the system correspond to the system shown in FIG. 1.

An advantage with the second embodiment, but also with the first embodiment, is that each pump may closed independently while the remaining pumps may continue pumping at optimal efficiency and without requiring modification of the feed system itself.

Figure 7:
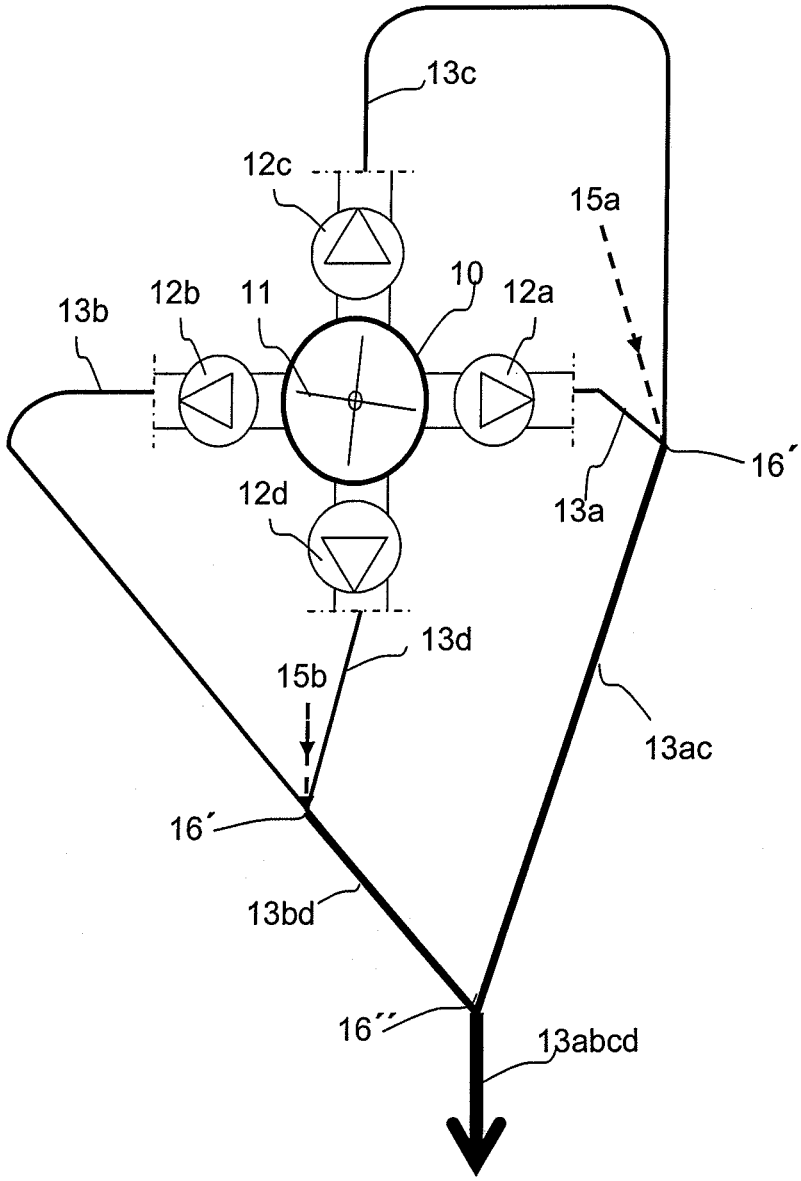
FIG. 7 shows how the transfer lines from each pump in the systems in FIGS. 1 and 2 may be combined to form one single transfer line.

FIG. 7 shows an example of how supply lines 15*a*, 15*b* that are used in both the first and the second embodiment may be connected to the merging points 16' in the case 4 pumps 12*a*-12*d* are used. An advantage with this addition arrangement is that it is possible to guarantee optimal speed in the joint flow in the second section 13*ac*/13*bd* and in the joint flow after the merging point 16" in the final third section 13*abcd* of the transfer line.

It is critical that the rate of the flow up to the digester is well over 1.5-2 m/s so that the chips in the flow do not sink down towards the feed flow and cause plugging of the transfer line. The flow in the transfer line should suitably be maintained between 4-7 m/s to make sure that the chips are transferred to the top of the digester.

If, for example, pump 12*a* would be shut down due to repair or a desired capacity reduction, the flow in addition line 15*a* may be increased so that the flow rate in the second section 13*ac* is maintained.

In these combined line systems for transferring chips suspensions it is advantageous that the lines after the merging points 16, 16', 16" have a flow cross section that is equal to or greater than the sum of the incoming lines, to avoid pressure loss in the transfer lines. Suitable equations for flow areas A may be:

$$A_{13bd} \geq (A_{13d}+A_{13b}), \text{ and}$$

$$A_{13abcd} \geq (A_{13bd}+A_{13ac}).$$

In a transfer line where the first section has a diameter of for example 100 mm and an established flow rate of 5 m/s, a flow rate of 4.4 m/s is established if a second section that combines 2 lines with diameter 100 mm has a diameter of 150 mm. With a subsequent combination of 2 such lines with a diameter of 150 mm to a third section with a diameter of 250 mm, a flow rate of 3.18 m/s may be established. All these flow rates have a marginal towards the critical lowest flow rate.

The supply lines 15*a*, 15*b* may also have connections directly after each pump outlet, so that the line between pump and merging point is kept flushed during the time that the pump is shut down or operated at a reduced capacity. The addition of extra fluid may also be combined with a further dilution of the chips suspension before the pumps, for example on the suction side of the pumps or in the bottom of vessel 3.

Figure 8:
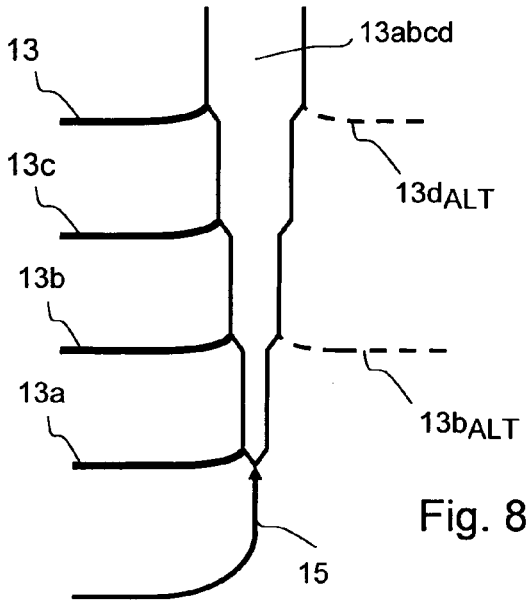
FIG. 8 shows how the transfer lines from each pump in the systems in FIGS. 1 and 2 may be combined to form one single transfer line.

FIG. 8 shows a cross-sectional view of a second embodiment of how lines 13*a*-13*d* from the pumps may be combined to form one single transfer line 13*abcd*. Here, the supply line 15 for dilution liquid provides a vertical part of the transfer line towards the top of the digester, and each line 13*a*, 13*b*, 13*c*, 13*d* from each pump is connected successively, one by one, to this vertical part of the transfer line at different heights. At each addition position, the chip flow is added in a conical part of a diameter increase in the transfer line. As is indicated by the dashed alternatives 13*b*$_{ALT}$/13*d*$_{ALT}$, the connections from the pumps may instead be shifted from side to side on the transfer line.

Figure 9:
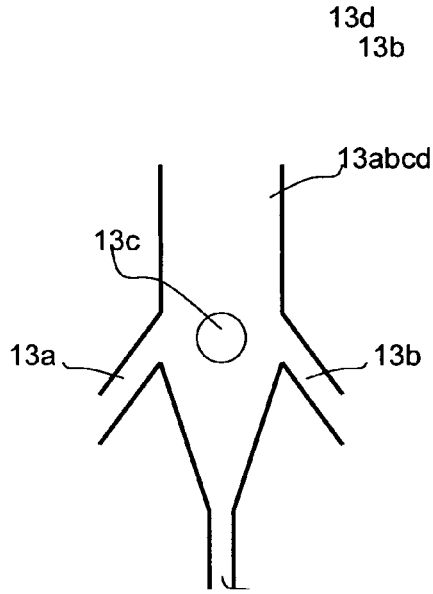
FIG. 9 shows how the transfer lines from each pump in the systems in FIGS. 1 and 2 may be combined to form one single transfer line.

FIG. 9 shows a cross-sectional view of a third embodiment of how lines 13*a*-13*d* from the pumps may be combined to form one single transfer line 13*abcd*. Here, the supply line 15 for dilution liquid provides a vertical part of the transfer line towards the top of the digester, and each line 13*a*, 13*b*, 13*c*, 13*d* from each pump is connected at the same height to this vertical part of the transfer line. preferably the addition position for the chips flow is arranged in a conical part of a diameter increase in the transfer line and each connected line is oriented upwards and inclined at an angle in relation to the vertical orientation in the interval 20-70 degrees. The Figure shows only the connections 13*a*, 13*b*, 13*c*, as connection 13*d* is in the part that is cut away in this view.

The invention is not limited to the above mentioned embodiments. More variations are possible within the scope of the following claims. In the embodiment shown in FIG. 1, in some applications the strainer SC1 and the return line 40 may for example be omitted, preferably for cooking of wood material with a higher bulk density, such as hardwood (HW), that for a corresponding production volume require less liquid during transfer.

In the case where a raw wood material that is easy to impregnate and neutralise is used, for example raw wood material such as pin chips or wood chips with very thin dimensions and a quick impregnation time, vessel 3 may in extreme cases be a simple spout with a diameter essentially corresponding to the bucket formed outlet 10 in the bottom of the vessel.

If the chips fed into the vessel 3 are already well steamed, the liquid level $LIQ_{LEV}$ may be established above a chips level $CH_{LEV}$. In the embodiments shown, an alkali pre-treatment was used in vessel 3, but it is also possible to use a process where this pre-treatment comprises acid pre-hydrolysis.

While the present invention has been described in accordance with preferred compositions and embodiments, it is to be understood that certain substitutions and alterations may be made thereto without departing from the spirit and scope of the following claims.

The invention claimed is:

1. A feed system for a continuous digester wherein wood chips are continuously fed into a top of the digester and fed out from a bottom of the digester, comprising:

a liquor line connected to a vessel for suspending the wood chips, that are to be fed into the top of the digester, to create a chips suspension, at least two pumps connected in parallel to a bottom of the vessel, the chips suspension being pumpable by the at least two pumps through first sections of a transfer line, each first section extending from each pump, each first section being combined at a merging point to form a combined second section of the transfer line, the combined second section extending from the merging point to the top of the digester, and a dilution line connected to the merging point.

2. The feed system according to claim 1 wherein at least three pumps are connected in parallel to the bottom of the vessel.

3. The feed system according to claim 2 wherein at least four pumps are connected in parallel to the bottom of the vessel.

4. The feed system according to claim 2 wherein at least a second section of the transfer lines from at least two pumps in a first pump group are combined with another section of the transfer lines from at least one pump in a second pump group at a merging point to a common third section of the transfer line before the third section extends towards the top of the digester.

5. The feed system according to claim 1 wherein the pumps are connected symmetrically to the bottom of the vessel.

6. The feed system according to claim 1 wherein in the vessel is arranged a supply line for the addition of fluid controlled by a level transmitter that is adapted to establish a liquid level ($LIQ_{LEV}$) in the vessel.

7. The feed system according to claim 1 wherein the outlet of the transfer line opens directly into the top of the digester.

8. The feed system according to claim 1 wherein a bucket-shaped outlet is connected to the bottom of the vessel, the bucket-shaped outlet having an upper inlet defined therein, a cylindrical mantle surface, and a bottom, at least two pumps in parallel having pump inlets and pump outlets defined therein, the pump inlets being connected to the cylindrical mantle surface, the pump outlets being connected to a transfer line that extends to the top of the digester, a stirrer disposed at the bottom of the vessel and arranged to rotate in the bucket-shaped outlet, and the stirrer having at least two scraper arms that are adapted to sweep over the pump inlets arranged in the mantle surface of the bucket-shaped outlet.

* * * * *